United States Patent [19]

Mairs

[11] 4,129,012

[45] Dec. 12, 1978

[54] HEAT TRANSFER METHOD AND APPARATUS

[75] Inventor: John H. Mairs, Berwick, Australia

[73] Assignee: Newton, John, Chadstone, Australia; a part interest

[21] Appl. No.: 788,132

[22] Filed: Apr. 18, 1977

[30] Foreign Application Priority Data

Apr. 20, 1976 [AU] Australia ..... PC5652

[51] Int. Cl.[2] ..... F25B 41/00; F25B 5/00

[52] U.S. Cl. ..... 62/113; 62/117; 62/196 R; 62/513

[58] Field of Search ..... 62/113, 500, 513, 191, 62/196 R, 196 A, 196 B, 196 C

[56] References Cited

U.S. PATENT DOCUMENTS

| | | | |
|---|---|---|---|
| 1,882,257 | 10/1932 | Randel | 62/500 |
| 2,411,186 | 11/1946 | Boeckeler | 62/500 |
| 2,755,639 | 7/1956 | Straznicky | 62/513 |
| 3,130,558 | 4/1964 | Gardner | 62/513 |
| 3,134,241 | 5/1964 | Johnson | 62/196 B |
| 3,201,950 | 8/1965 | Shrader | 62/513 |
| 3,277,659 | 10/1966 | Sylvan et al. | 62/500 |
| 3,320,758 | 5/1967 | Harper | 62/117 |
| 3,500,897 | 3/1970 | Von Cube | 62/500 |
| 3,670,519 | 6/1972 | Newton | 62/191 |

*Primary Examiner*—Lloyd L. King

[57] ABSTRACT

Method and apparatus of transferring heat from a substance by way of an intermediate compressible fluid in which the heated fluid is compressed during intermittently spaced periods for subsequent cooling, high pressure fluid being fed back into the low pressure side during and immediately after the periods of compression.

13 Claims, 4 Drawing Figures

HEAT TRANSFER METHOD AND APPARATUS

Figure 1:
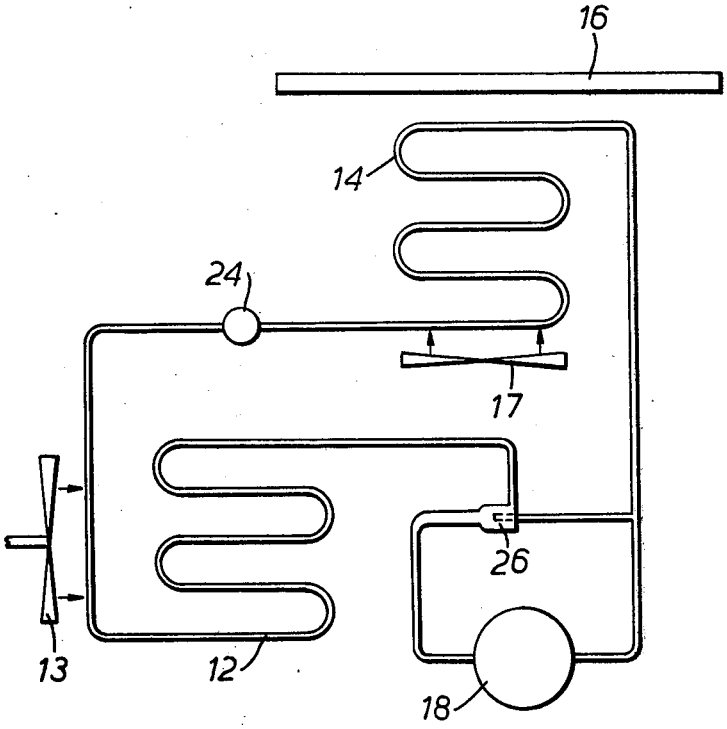

This invention relates generally to processes in which heat is extracted from a substance in a heat exchange operation and stored in an intermediate fluid, after which the fluid is intermittantly compressed and subjected to a further heat exchange operation in which the stored heat is dissipated from the liquid. Such processes form the basis of evaporator/condenser refrigeration processes and are commonly put to effect in air conditioning units in which the substance cooled is the atmosphere of a confined space such as the interior of a building or motor vehicle.

It is now common practice for motor vehicle manufacturers to incorporate evaporator/condenser refrigeration units as an option for their vehicles but the adaptation of such units to motor vehicle has not been without difficulties. The principal of these has been the frequent inability of engines, especially the smaller engines now popular, to cope at idle with both the air conditioning system and emission control devices, stalling and overheating being typical responses. These difficulties have been met in various ways such as by preventing activation of the compressor at or near idle, by throttling up engine speed when the compressor switches in or by providing a continuously operating compressor in conjunction with a valve arranged to shut off the evaporator and maintain the pressure and temperature therein at predetermined levels. Another known expedient with continuously operating compressors is the provision for feed back of compressed gas to the intake side of the compressor through a valve which opens and closes in dependence upon the temperature or pressure in the compressor suction line. See for example, U.S. Pat. Nos. 2,774,219; 3,320,758 and 3,651,657. Such valved pressure dependent feed back lines have also been long employed for unloading compressors at start up or for determining a maximum compressor speed, such as is described in U.S. Pat. No. 3,044,273.

U.S. Pat. No. 3,134,241 discloses an arrangement in which, with a view to reducing compressor workload, compressed gas is led into the neck of an ejector disposed in the line along which liquid is returned from the condenser to the evaporator.

It is an object of this invention to provide a heat transfer process, and a corresponding apparatus, in which the aforesaid difficulties are overcome in a novel and improved manner. The invention achieves this end by being specifically directed to a reduction of condenser temperature and pressure, and derives from the realization, a realization which is not necessarily self evident, that if vapour from the high pressure or condenser side of an evaporator/condenser refrigeration cycle is continuously fed back and mixed with vapour at the low pressure or evaporator side, the condenser pressure and temperature is reduced as desired without any disadvantageous loss of efficiency at the compressor.

The invention accordingly provides a method of transferring heat from a substance in which method heat is extracted from the substance in a heat exchange operation and stored in a compressible fluid which is progressively compressed during intermittently spaced periods and subjected to a further heat exchange operation in which the stored heat is dissipated from the fluid, wherein fluid already compressed is continuously fed back and mixed with fluid not yet compressed at a controlled rate both substantially throughout and immediately after said periods of progressive compression whereby to reduce the rate of said dissipation of heat during said periods of progressive compression.

Preferably the compressed fluid, which may be a commercial refrigerant, is allowed to flow as prescribed by being directed through an ejector device in which the fed back fluid and the as yet uncompressed fluid are mixed and discharged at a pressure between the two input pressure or, more advantageously still, at a pressure approaching the higher of the pressures subject to the limitations set by the critical pressure ratio for the system.

The invention also provides a heat transfer circuit comprising a first heat exchange means for extracting heat from a substance in a heat exchange operation and storing it in compressible fluid, compressor means connected to receive compressible fluid from the first means and to progressively compress it during intermittently spaced periods, and second heat exchange means connected to receive compressed fluid from the compressor means and to subject it to a further heat exchange operation in which the stored heat is dissipated from the fluid, wherein the circuit includes a feed back line by which, in use of the circuit, fluid already compressed is continuously fed back and mixed with fluid not yet compressed at a controlled rate both substantially throughout and immediately after said periods of progressive compression whereby to reduce the rate of said dissipation of heat during said periods of progressive compression.

Said controlled rate of flow back is preferably substantially less than the rate of flow through the compressor during its operation.

Figure 2:
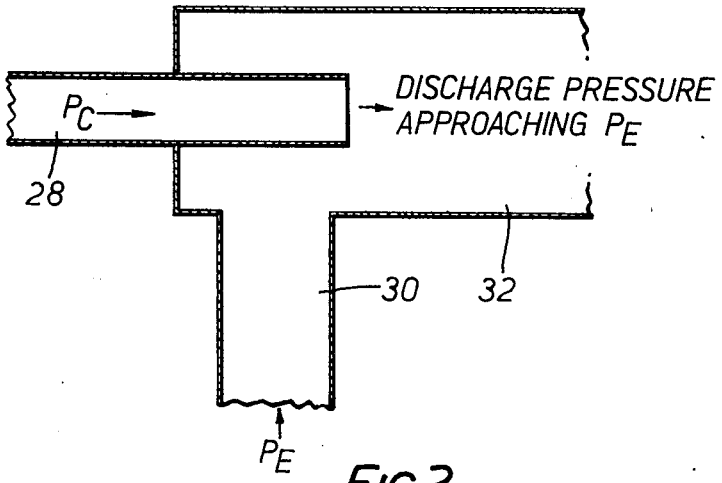
Figure 3:
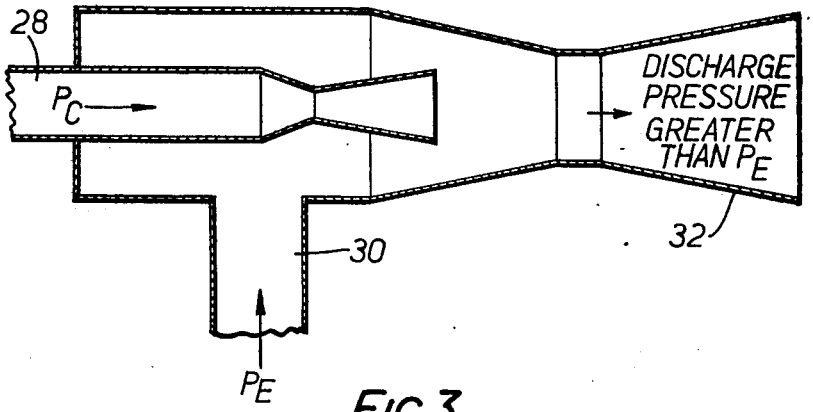
Figure 4:
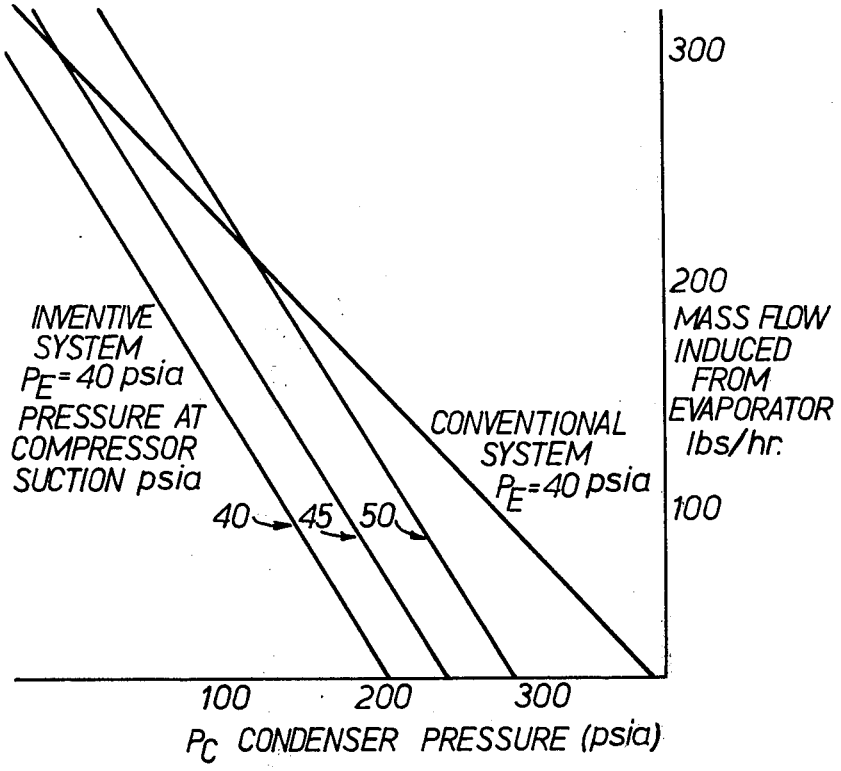

The invention will now be described by way of example with reference to the accompanying drawings, in which:

FIG. 1 schematically depicts a motor vehicle refrigeration circuit assembled in accordance with the invention;

FIGS. 2 and 3 are axial cross-sections of two designs of ejector for use in the circuit of FIG. 1; and FIG. 4 is a graph, relative to the circuit of FIG. 1, of condenser pressure as a function of mass flow induced from the evaporator for varying evaporator pressures.

The illustrated circuit includes an evaporator coil 12 disposed in heat exchange relationship with an air stream force ventilated by a blower 13 into the cabin of the vehicle, a condensor coil 14 disposed immediately in front of the vehicle radiator 16 in heat exchange relationship with atmospheric ambient air induced in part by engine drive fan 17 to pass into the front of the vehicle, and a compressor 18 is mounted to be driven by the vehicle engine from the crank shaft by way of belts and a clutch, which is typically magnetically operated. In operation of the circuit, liquid refrigerant flows from the condenser 14 to the evaporator 12 under the control of the usual thermostatic expansion valve 24. The fluid is vapourised in the evaporator on taking up heat from the forced airflow, duly compressed and passed for cooling and condensation in the condenser. The compressor is operated during intermittantly spaced periods only in dependence upon one or more parameters monitored in the evaporator or in the suction line of the compressor.

In accordance with the invention, the compressor is shunted by an ejector device 26 which permits feed back flow of refrigerent vapour from the high pressure side of the compressor to the suction side at a controlled rate determined by the cross-sectional configuration of the device and by the pressure differential across the device. The ejector is of conventional design and may suitably exhibit one of the axial sections illustrated in FIGS. 2 and 3. Typically, with reference to these drawings, the high pressure vapour enters at inner duct 28, the low pressure vapour from the evaporator along the surrounding annular path 30. The flows mix and pass on through outlet 32 at a net pressure which, depending on the precise design of the ejector, may lie between the two intake pressures while approaching $P_E$, as in the case of the device of FIG. 2, or, as for that of FIG. 3, approach the higher intake pressure subject to the limitations set by the critical pressure ratio for the system. Desirably, the inner tube 28 is of such diameter as to produce chocked flow within the range of operating pressures envisaged. By chocked flow is meant flow in which the velocity of the stream passing through the inner tube is equal to the local velocity of sound in the stream. For reasons which will become apparent subsequently, there are found to be advantages in making provision for the latter result.

In operation of the circuit during a period in with the compressor is on, the continuous flow fed back through the ejector device 26 will result in a substantially lower condenser pressure, and therefore temperature, than would be acquired in the absence of the ejector. As mentioned previously, this surprisingly does not result in an unacceptable reduction in compressor effeciency as it is found that the rate of loss of vapour mass at the high pressure side of the circuit is at least almost matched by a corresponding increase in the mass capacity of the compressor which is seen as a consequence of the reduction in the actual pressure gain across the compressor. In the case of an ejector device (FIG. 3) in which the ejector outflow pressure, and therefore the compressor suction pressure, approaches the condenser pressure, it is in fact found experimentally, and borne out by mathematical derivation, that the efficiency of the compressor is enhanced.

The primary advantage of the inventive technique resides in the attainment of lower condenser pressure and temperature while the compressor is on without the introduction of other unacceptable side-effects in the operation of the circuit The reduction is found to be as great at 25% relative to systems not modified in accordance with the invention and inevitably leads to a lower rate of heat dissipation from the condenser. As a result, in the case of a vehicle air conditioning system as illustrated, the airflow entering the vehicle radiator does so at a somewhat lower temperature and the risk that the vehicle engine will overheat when the car is not in motion or travelling at low speed is substantially lessened.

It is believed that this advantageous result is achieved not by indefinite storage of heat within the system but by a smoothing out of the heat transfer characteristic at the condenser. Clearly, maximum condenser pressures are conventionally obtained during and immediately after operation of the compressor and very high rates of heat transfer occur at these periods of the cycle. In the inventive arrangement, however, the peak compressor temperature is substantially reduced and heat dissipation is spread over a greater period of time: once the compressor is switched out it will be seen that the feed back flow at the ejector will be maintained as pressure throughout the system very rapidly balances out.

A secondary, though nevertheless important, advantage of the inventive proposal is the reduction in power requirements for the compressor arising from the lower pressure ratio at the compressor. Thus, the power drain on the vehicle engine caused by the compressor is reduced, thus correspondingly lessening the problems inherent in the adaptation of air conditioning systems to emission controlled vehicles.

An exemplary analysis of the behaviour of the vapour side of the illustrated refrigeration circuit will now be set out. In particular, it is desired to illustrate the manner in which forms describing the relationship between the evaporator pressure $P_e$ and the condensor pressure $P_c$ can be determined.

For the purposes of this calculation, it is proposed to consider a compressor having a compression ratio of 7:1, a displacement of 12.6 inches$^3$ per revolution and an operational speed of 800 revolutions per minute. The refrigerant is R12 which has a molecular weight of 120.9, a gas constant of 12.78, a $\gamma$ value of 1.137 and a heat of vapourization of 71.04 B.T.U./lb.

In deriving the following forms, the known terms for iso-thermal conditions were used, although it is known that generally adiabatic conditions exist. The reason for this is that to use the adiabatic expressions complicates the analysis to an extent that does not appear justified, bearing in mind the well known difficulties and uncertainties associated with dynamic analysis. The purposes of this discussion is primarily to establish trends. However, it is felt that there is a reasonable degree of accuracy obtained in the calculations, and this view has been borne out by subsequent experiment.

It will be take that pressure P is measured in lb.f. in $^{-2}$ absolute (p.s.i.a.) and temperature T, in degrees rankin (°R) $P_c$ and $T_c$ will be used to denote conditions in the condensing coil.

From the expression:

$$\left(\frac{2}{\gamma+1}\right)^{\frac{\gamma}{\gamma-1}} P_c$$

we have the critical pressure ratio as $0.577P_c$.

From the expression $2T_c/\gamma+1$, we have the critical temperature as $0.936T_c$.

It will be taken that an approximate solution to the vapour pressure curve for R12, of sufficient accuracy for this exercise, is given by $T = 1926/5.554 - \log P$, where P is pressure in psia, the T is temperature in °R. From the expression $P/\rho = RT$ we have $\rho$ in lb.ft$^{-3}$ = $P \times 144/12.78T$, where $\rho$ is density.

Substituting for T, we have $\rho = P \times 144 \times (5.554 - \log P/12.78 \times 1926 = 0.00585\ P(5.554 - \log P)$ lb.ft$^{-3}$ From the expression Velocity $= \sqrt{\gamma RT}$, substituting we have, for the velocity in feet per second, at choked conditions. $V = \sqrt{1.137 \times 12.78 \times 0.936 \,.\, 32.2 \times T_c}$ However $T = 1926/5.554 - \log P$ therefore velocity $= 918.5\sqrt{1/5.554 - \log P}$ ft second $^{-1}$ Since the volume throughput is velocity x area, we may write Volume $= 918.5\sqrt{1/(5.554 - \log P)} \times \pi D^2/4 \times 144$ where D is is the diameter of the inner duct of the ejector in inches.

That is, volume $5.010\ D^2\ 1/(5.554 - \log P)$ ft$^3$ sec$^{-1}$

Now mass flow $\dot{m}$ = volume $\times\ \rho$, and putting $D$ = 0.073 inches, we have the mass flow through the duct, for critical conditions, as $\dot{m} = 0.347\, P\sqrt{5.554 - \log P}$ lbs hour $^{-1}$ Referring to the conditions specified for the compressor, we have the head volume, that is remaining cylinder volume when the piston is at top dead centre, as 58.34 $ft^3$, and the total cylinder volume as 408.4 $ft^3 hour^{-1}$. For this purpose, volumetric inefficiencies, sub cooling and super heating will be neglected. Taken that heat pressure equals the condensing coil pressure, $P_c$, we have the charge remaining in the cylinder at top dead centre as $58.34 \times 0.00586 P_c\,(5.554 - \log P_c) = 0.341\, P_c\,(5.554 - \log P_c)$ lb hour $^{-1}$ For a given evaporator pressure $P_e$, the mass of charge in the cylinder at bottom dead centre is $408.4 \times 0.00585 P_e\,(5.554 - \log P_e) = 2.389\, P_e\,(5.554 - \log P_e)$ lb hour$^{-}$.

The mass of charge which can be induced by the compressor from the evaporator is therefore $$2.389 P_e\,(5.554 - \log P_e) - 0.341 P_c\,(5.554 - \log P_c) \text{ lb hour}^{-1} \quad (1)$$

This is for a system in which the ejector is of the type in which output pressure is generally between the two intake pressures. For a system in which the output pressure of the ejector approaches the higher intake pressure (FIG. 3) the quantity which can be induced is $$2.389 P_e(5.554 - \log P_e) - 0.341 P_c(5.554 - \log P_c) - 0.347 P_c(5.554 - \log P_c) \text{ lb hour}^{-1}$$

Referring to the case represented by equation (1), FIG. 4 shows the relationship of $P_c$ to mass flow induced from the evaporator $P_e$ = 40, 45 and 50 psia.

It will be observed from the graph that if a constant mass flow is to be induced from the evaporator, the condenser must operate at lower pressures when using the inventive system. Experimentally, the system operates at a 25% lower $P_c$ than a standard system for given heat rejection and evaporator loading at normal $P_c$'s. This figure virtually remains constant over the useful range, which is consistant with the fact that the equation for mass flow through the inner duct of the ejector is virtually linear. Taking a standard system at a $P_c$ = 180 psia, the system can induce 156 lb hour$^{-1}$. Under similar air-on conditions the $P_c$ will drop to 135 psia when using the inventive system at which pressure the mass flow through the jet is 86.7 lb/hour. At a $P_c$ – 135 psia, the system with an ejector in which output pressure approaches $P_e$ will induce a mass flow from the evaporator of 132 lb/hour, a drop of 24 lbs/hour when compared with the standard system.

With ejectors operating at compression ratios of 1.125:1 and 1.25:1 respectively, both of which are easily obtainable, in the first instance the induced flow from the evaporator rises to 172 lbs/hour, a gain of 16lb/hour on the standard system and to 214 lbs/hour, a gain of 58 lbs/hour with the lower output pressure ejector. Mass flow at the ejector high pressure intake remains constant in all cases. It will thus be seen that results range from an acceptable drop in efficiency when using an ejector of lower output pressure, to increased efficiencies with increasing compression ratio of the ejector and the output pressure approaching $P_c$, and that these results are obtained at lower compression head pressures which, as already mentioned, is highly desirable in itself.

I claim:

1. In method of transferring heat from a substance in which method heat is extracted from the substance in a heat exchange operation and stored in a compressible fluid which is progressively compressed during intermittently spaced periods and subjected to a further heat exchange operation in which the stored heat is dissipated from the fluid, the improvement wherein fluid already compressed is continuously fed back and mixed with fluid not yet compressed at a controlled rate both substantially throughout and immediately after said periods of progressive compression whereby to reduce the rate of said dissipation of heat during said periods of progressive compression.

2. The improved method according to claim 1 wherein the flow of the feed back fluid is choked as hereinbefore defined.

3. The improved method according to claim 1 wherein the compressed fluid is fed back as prescribed by being directed through an ejector device in which the fluid being fed back and the as yet uncompressed fluid are mixed and discharged at a pressure between the pressures of the two incoming fluid streams.

4. The improved method a-cording to claim 3 wherein the flow of the feed back fluid into the ejector device is choked as hereinbefore defined.

5. The improved method according to claim 1 wherein the compressed fluid is fed back as prescribed by being directed through an ejector device in which the fluid being fed back and the as yet uncompressed fluid are mixed and discharged at a pressure approaching the higher of the pressures of the two incoming fluid streams subject to the limitations set by the critical pressure ratio for the system.

6. The improved method according to claim 5 wherein the flow of the feed back fluid into the ejector device is choked as hereinbefore defined.

7. In a heat transfer circuit comprising a first heat exchange means for extracting heat from a substance in a heat exchange operation and storing it in compressible fluid, compressor means connected to receive compressible fluid for the first means and to progressively compress it during intermittently spaced periods, and second heat exchange means connected to receive compressed fluid from the compressor means and to subject it to a further heat exchange operation in which the stored heat is dissipated from the fluid, the improvement wherein the circuit includes a feed back line by which, in use of the circuit, fluid already compressed is continuously fed back and mixed with fluid not yet compressed at a controlled rate both throughout and immediately after said periods of progressive compression whereby to reduce the rate of said dissipation of heat during said periods of progressive compression.

8. The improved heat transfer circuit according to claim 7 wherein the feed back line incorporates an ejector device structured whereby in use of the circuit, the fluid being fed back and the as yet uncompressed fluid are mixed and discharged at a pressure between the pressures of the two incoming fluid streams.

9. The improved heat transfer circuit according to claim 7 wherein the feed back line incorporates an ejector device structured whereby in use of the circuit, the fluid being fed back and the as yet uncompressed fluid are mixed and discharged at a pressure approaching the higher of the pressures of the two incoming fluid streams subject to the limitations set by the critical pressure ratio for the system.

10. The improved heat transver circuit according to claim 7 wherein the first and second heat exchange means are respectively an evaporator in which the fluid, in a liquid state, is vaporised on taking up said heat from the substance and a condenser in which the compressed vapour is condensed on said dissipation of its stored heat.

11. The improved heat transfer circuit according to claim 10 wherein the feed back line incorporates an ejector device structured whereby in use of the circuit, the fluid being fed back and the as yet uncompressed fluid are mixed and discharged at a pressure between the pressures of the two incoming fluid streams.

12. The improved heat transfer circuit according to claim 10 wherein the feed back line incorporates an ejector device structured whereby in use of the circuit, the fluid being fed back and the as yet uncompressed fluid are mixed and discharged at a pressure approaching the higher of the pressures of the two incoming fluid streams subject to the limitations set by the critical pressure ratio for the system.

13. The improved heat transfer circuit of claim 7, wherein the feedback line incorporates an ejector device structured such that the flow of the feedback fluid is choked as hereinbefore defined.

* * * * *